US007367562B2

(12) United States Patent
Scheb, Jr. et al.

(10) Patent No.: US 7,367,562 B2
(45) **Date of Patent: *May 6, 2008**

(54) GAME OF CHANCE

(76) Inventors: Paul Scheb, Jr., 1850 Bellevue Ave, Deptford, NJ (US) 08096; Michael Scheb, 21 Strathaven Dr., Broomal, PA (US) 19008; Paul Scheb, III, 135 Wyndmoor Rd., Springfield, PA (US) 19064; Patrick Scheb, 112 Westdale Rd., Upper Darby, PA (US) 19082

( * ) Notice: Subject to any disclaimer, the term of this patent is extended or adjusted under 35 U.S.C. 154(b) by 0 days.

This patent is subject to a terminal disclaimer.

(21) Appl. No.: 11/590,030

(22) Filed: Nov. 1, 2006

(65) Prior Publication Data

US 2007/0040331 A1 Feb. 22, 2007

Related U.S. Application Data

(63) Continuation of application No. 10/764,072, filed on Jan. 23, 2004, now Pat. No. 7,152,863.

(51) Int. Cl.
*A63F 3/00* (2006.01)
*A63F 9/04* (2006.01)

(52) U.S. Cl. ..... 273/274; 273/146; 463/16; 463/22

(58) Field of Classification Search ..... 273/274, 273/146; 463/16, 22
See application file for complete search history.

(56) References Cited

U.S. PATENT DOCUMENTS 2,577,087 A * 12/1951 Meeks ..... 273/145 D
6,209,874 B1 * 4/2001 Jones ..... 273/274
7,152,863 B2 * 12/2006 Scheb et al. ..... 273/274
2003/0218300 A1 * 11/2003 Timmons, Sr. ..... 273/146

* cited by examiner

*Primary Examiner*—Benjamin H Layno
(74) *Attorney, Agent, or Firm*—SonnabendLaw; Jeffrey Sonnabend

(57) ABSTRACT

A method of playing a game of chance comprising the steps of defining a set of wagers on the outcome of a plurality of differentiable random events, said random events defining an aggregate event, defining a set of payout odds associated with said wagers, accepting at least one player wager for at least one wager in said set of wagers, generating said plurality of differentiable random events, and paying winning wagers according to said payout odds.

15 Claims, 8 Drawing Sheets

GAME OF CHANCE

CROSS REFERENCE TO RELATED APPLICATIONS

The present application is a continuation of application Ser. No. 10/764,072 filed Jan. 23, 2004 now U.S. Pat. No. 7,152,863.

BACKGROUND OF THE INVENTION

1. Field of the Invention

The present invention relates to the field of entertainment and games, and more particularly, to the field of games of chance. The present invention is relevant more specifically to the field of casino games and parlor games.

2. Background of the Related Art

Games incorporating elements of chance are well known. These games are known both in the context of casino games as well as parlor games. Games of chance generally revolve around the outcome or outcomes of some random or quasi-random event or events. These events have a limited set of possible outcomes, although the set of possible outcomes may be very large. Generally, game players attempt to predict the outcome of one or more events prior to their occurrence. Game winners may be determined by correctly predicting all or part of the outcome of the event or events.

Games of chance have particular application in the field of casino gaming. Casino gaming as used herein is understood to include gambling applications outside of actual casinos, for example, in locations such as bars, airports and the like which may have gambling. It is understood that casino gaming may include both table-based gaming, as well as machine-based gaming, including, for example, mechanical slot machine gaming and computer controlled machine gaming.

Well known casino games include craps, roulette, black-jack, pai gow poker, pai gow, the wheel of fortune, slot machines, video poker, keno, baccarat, mini-baccarat, Spanish-21, casino war, and poker. Also well know are games such as state lotteries and daily numbers drawings The principal goal of games of chance are to provide entertainment. In the casino and gambling context, successful games attract and maintain the interest of players, thereby generating income for the casino or other game host. These games of chance ideally provide action and excitement for players, have relatively easy to learn rules which do not use complicated rankings of various outcomes (e.g., poker hand valuations), and permit a variety of different wagers to keep players' interest.

In order to create a sense of competition, and therefore excitement and interest, certain presently known games of chance determine winners by comparing the outcome of a player's event (such as the roll of one or more dice) against the results of a similar event of a "dealer" or other player.

One example of such a game of chance applicable in the casino setting is disclosed in U.S. Pat. No. 5,413,351, which discloses a dice game involving wagering on the outcome of a roll of three dice. One or more players place wagers and then roll dice against a dealer. Game results depend on the occurrence of a predefined set of outcomes and/or the relative values of the player's and dealer's outcomes.

U.S. Pat. No. 5,513,850 discloses a game in which a player and a dealer develop "hands" based on the outcome of one or more rolls of several dice by both the dealer and player. Game results depend on the value of the dealer's hand relative to the player's hand according to a predefined set of relatively complex rules.

U.S. Pat. No. 6,062,563 discloses a game in which a player and a dealer each rolls a set of dice. Wagers are made on the relative outcome of the two rolls. The player's dice ad dealer's dice may be differentiated from one another by color so as to avoid confusion upon each rolling his respective dice.

U.S. Pat. No. 5,695,193 discloses a game in which players play against one another or against a dealer. Game results are based on predefined combinations of dice outcomes Outcome combinations are compared to that of each player in turn and the combination with the highest value according to a pre-defined point values assigned to each possible outcome is deemed the winner.

Many players, however, seek to avoid confrontation and so disfavor games involving such inter-personal competition, even when such competition is against a casino as personified by a dealer.

Other presently known games attempt to create excitement by providing multiple wagering stages during the course of a single game. U.S. Pat. No. 5,513,851, for example, discloses a dice-based game requiring players to place at least one additional wager on at least one additional roll of several dice after successfully wagering on the outcome of a first roll of the several dice.

Still other presently known games attempt to attract players by providing a limited set of wagers which players may learn quickly. One such game is disclosed in U.S. Pat. No. 5,732,948, which discloses a dice-based game having a small set of available wagers. The outcome of the game is dependent on no more than two rolls of a pair of dice. The game may be terminated upon the occurrence of a predefined outcome during a first roll of dice, or upon the occurrence of certain outcomes of a second roll of dice relative to the outcome of the first roll the dice.

Similarly, U.S. Pat. No. 6,234,482 discloses a multiple dice game wherein players' wager relate to the outcome of a roll of three dice without differentiation of three dice. Wagers are limited to wagers regarding the total of the three dice and/or the existence of two or three identical numbers being rolled.

U.S. Pat. No. 6,508,469 discloses a multiple-dice game wherein players wager on the sum of the outcome of two rolls of three dice each and/or on poker-like outcomes (e.g., three-of-a-kind, straights, etc.) without differentiation of the dice. Wagers may be made before the first roll and/or between the first and second rolls.

U.S. Pat. No. 6,209,874 discloses a three-dice game having dice of three different colors. Players are limited to six types of wagers on the result of rolling three dice. A first type of wager is on the face-up sides of a selected two of the dice being equal both to each other and to a number selected by the player. A second type of wager is on the face-up side of a selected one of the dice indicating a selected number. A third type of wager is on the face-up side of a selected one of the dice indicating a number that is alternatively higher or lower than numbers indicated by the other two dice. A fourth type of wager is on the face up sides of the dice each being equal to each other and to a number selected by the player. A fifth type of wager is on the face-up sides of the dice indicating numbers having a sum which is a selected total number. A sixth type of wager is on the sum of numbers indicated by the face-up sides of the three dice being alternatively an odd number or an even number.

Due to the limited scope of available wagers, however, these games may not adequately maintain the interest of players. Certain presently known games address this issue by providing more complicated rules. One example is U.S. Pat. No. 5,350,175, which discloses a dice-based game wherein players wager on the outcomes of successive rolls of several dice. The game terminates upon the happening of certain pre-defined combinations of outcomes of the several rolls of the dice. Similarly, U.S. Pat. No. 6,070,872 discloses a combination card and dice-based game which proceeds through three distinct phases of random card and dice events. These games, however, may present rules which are too complicated for a number of typical players to comfortably learn or understand.

Finally, several currently known games involve game play which does not adequately develop excitement for players.

U.S. Pat. No. 5,806,847 discloses a game wherein players wager on the outcome of a single event such as the roll of a pair of dice. Several pre-defined wagers are disclosed, such as the outcome of the event being included in one or more predefined sets of outcomes. The single event results in a final and unequivocal outcome of all wagers, and so players are required to re-wager after each event, and no wager relies on the outcome of more than a single event.

U.S. Pat. No. 6,378,869 discloses a dice-based game wherein players wager on the outcome of rolls of two dice followed by the roll of a third die. Disclosed wagers include individual wagers for each possible sum of the dice values as rolled, hi/lo outcome sets (i.e., wagers that the sum of the values rolled will fall within 4 to 10 inclusive or 11 to 17 inclusive) and odd/even outcomes.

Games of chance in the parlor game context may include simulations of casino gaming, as well as point driven and other games not directly related to gambling.

With these considerations in mind, it is desirable to have a game which provides action and excitement for players, has relatively easy to learn rules which do not use complicated rankings of various outcomes, permits a variety of wagers to keep players' interest and builds excitement throughout each game.

SUMMARY OF THE INVENTION

The subject invention is directed to a new and useful game of chance particularly well suited for casino and parlor play. The present invention has the advantages of providing a variety of different wagers to players, both easy to learn as well as more complicated. Additionally, the present invention includes multi-staged play which builds excitement for players without forcing players to make multi-tiered wagers.

A method of playing a game of chance is disclosed, one preferred embodiment having the steps of defining a set of wagers on the outcome of a plurality of differentiable random events, the random events defining an aggregate event; defining a set of payout odds associated with the wagers, accepting at least one player wager for at least one wager in the set of wagers, generating the plurality of differentiable random events, and paying winning wagers according to the payout odds.

Also disclosed is a preferred embodiment of the present invention in the form of a method of playing a game of chance having the steps of: selecting a wager from a pre-defined set of wagers on the outcome of a plurality of differentiable random events, the random events defining an aggregate event and the pre-defined set of wagers having a pre-defined set of payout odds associated therewith, awaiting the outcome of the plurality of differentiable random events, and collecting payment for winning wagers according to the payout odds.

Finally, a preferred embodiment is disclosed in the form of a game of chance having a wager area for accepting wagers, the wager area having set of wagers on the outcome of a plurality of differentiable random events, the random events defining an aggregate event, a set of payout odds associated with the wagers and a random event generator for generating the plurality of differentiable random events, wherein winning wagers accepted in the wager area are paid in accordance with the payout odds.

The set of wagers may include a plurality of wager groups, the wager groups including a first wager group having single, double and trifecta wagers and a second wager group having wagers on the aggregate event. The plurality of differentiable random events may include a first, second, third and fourth random event, and the first wager group may include a single wager on the first random event, a double wager on the first and second random events, and a trifecta wager on the first, second and third random events.

The aforementioned first wager group further may include a single wager on the second random event, a double wager on the second and third random event, and a trifecta wager on the second, third and fourth random events.

The further step of generating a bonus random event may be included and the wager groups may then include a third wager group having wagers on the bonus random event.

The third wager group may include a single wager on the third random event, a double wager on the third and fourth random events, and a trifecta wager on the third, fourth and bonus random events. Additionally, the third wager group may include a single wager on the fourth random event and a double wager on the fourth and bonus random events.

The plurality of differentiable random events may include a first, second, third and fourth random event and the second wager group may include a plurality of wagers on aggregate values of the first, second, third and fourth random events. The second wager group may include an over-under wager.

The further step of generating a bonus random event may be included, and the wager groups may then include a third wager group having wagers on the bonus random event.

The third wager group may include a wager on a combination of an over-under and the bonus random event. Additionally, the second wager group may include one or more block wagers.

The aforementioned block wagers may have at least one of the group of: (a) wagers on blocks of two aggregate values of the first, second, third and fourth random events, (b) wagers on blocks of three aggregate values of the first, second, third and fourth random events, (c) wagers on blocks of four aggregate values of the first, second, third and fourth random events, (d) wagers on blocks of five aggregate values of the first, second, third and fourth random events, and (e) wagers on blocks of six aggregate values of the first, second, third and fourth random events.

In the foregoing embodiments, the second wager group may have at least one wager selected from the group of: four deuces, aces over any pair, any three of a kind, any four of a kind, 4-or-24, triple threes, big 6, any result over 20, all odd, all even, any straight, any two pair, and any result under 10.

The plurality of differentiable random events may be generated by random event generators having at least one of the group of: (a) one or more dice, (b) one or more prize wheels, (c) one or more roulette type wheels, (d) one or more air mix type random number generators, (e) one or more gravity fed random number generators, and (f) one or more pseudo random number generators.

These and other aspects of the subject invention will become more readily apparent to those having ordinary skill in the art from the following detailed description of the invention taken in conjunction with the drawings described herein.

BRIEF DESCRIPTION OF THE DRAWINGS

So that those having ordinary skill in the art to which the subject invention pertains will more readily understand how to make and use the subject invention, preferred embodiments thereof will be described in detail herein with reference to the drawings.

DETAILED DESCRIPTION OF THE PREFERRED EMBODIMENTS

Figure 1:
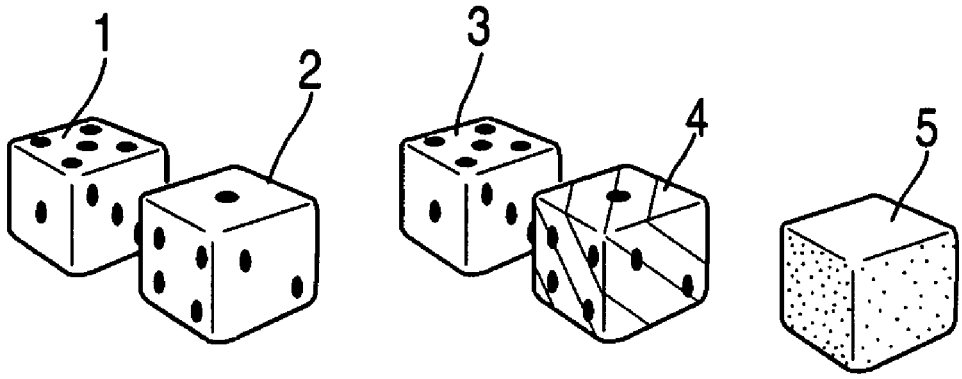
FIG. 1 is a depiction of dice utilized in a preferred embodiment of the present invention.

Referring now in detail to the drawings wherein like reference numerals identify similar structural features of the several embodiments of the subject invention, there is illustrated in FIG. 1 a set of dice for use in a preferred embodiment of the present invention. Each of the numbered dice, 1-4, includes six faces with representations of the numbers 1 through 6, although other symbols may be used for each face of a die, for example, horse names, shapes, letters or other symbols. In such cases, certain wagers based on mathematical calculations of results may not be directly applicable. If such calculation based wagers were desired in such cases, numeric values may be assigned to the various shapes, symbols, etc.

The numbered dice are color coded so as to differentiate themselves from one another. In one preferred embodiment, die 1 is colored red, die 2 is colored white, die 3 is colored blue and die 4 is colored white with red and blue stripes. Other differentiation schemes may be utilized to differentiate the dice, for example, dice may be of differing sizes, contained in color coded, named, or otherwise differentiable containers and the like.

The numbered dice 1-4 are rolled during game play to generate random events, and players may place one or more wagers on the outcome of the rolls of the numbered dice 1-4, alone or in combination, as discussed in further detail below.

"Bonus die" 5 is a six-sided die having only three different indicia; that is, each indicia is repeated on two different faces of the die. In one preferred embodiment of the present invention, the indicia of the bonus die are colors; that is, two sides are red, two sides are white, and two sides are blue. Any other distinguishable indicia may also be utilized. The bonus die is rolled during game play to generate a bonus event and players may place one or more wagers on the outcome of the roll of the bonus die either alone or in combination with other dice.

Figure 2:
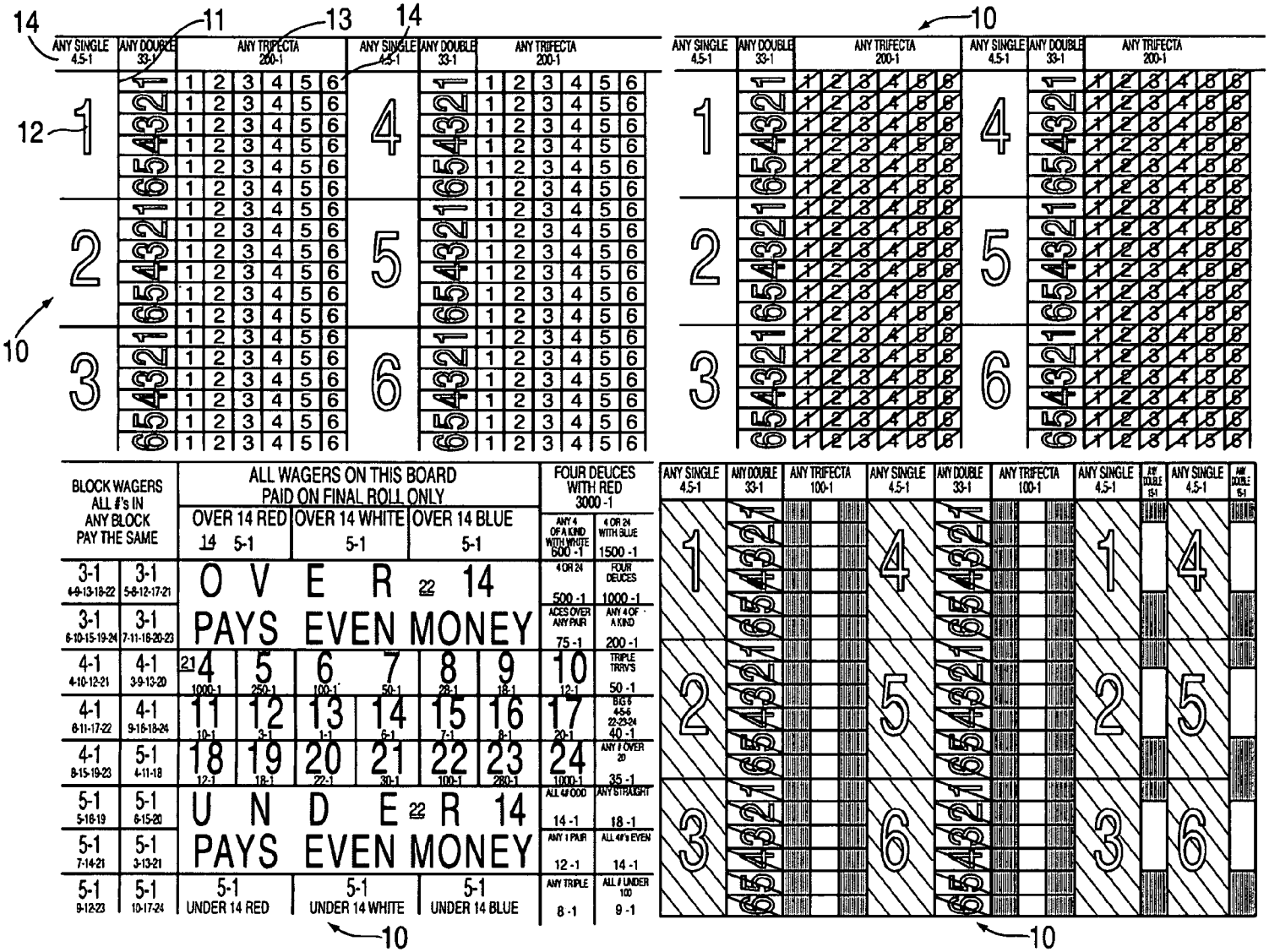
FIG. 2 is a playing board having several wager groups in accordance with a preferred embodiment of the present invention.

Players may place wagers by placing money, chips, chits or other indicators on a wagering surface demarcated with wager areas. A preferred embodiment of a playing surface of the present invention is shown in FIG. 2. Wager areas 14 are delineated by lines 11 drawn on the wagering surface. Wager indicators 12 contained within each wager area indicate the wager associated with the particular wager area. Payout indicators 13 may be placed on the wagering surface to indicated payout odds for the various wagers, thereby permitting players to readily determine what payouts they will receive for placing winning wagers. For example, payout odds of 4-1 means that for every one dollar placed on a winning wager (i.e., for every one dollar player wager), a player will receive four dollars payout. The wagering surface may be divided into two or more wager groups 10 containing similar or related wagers, for example, grouping one-roll wagers, red-white-blue wagers, white-blue-red wagers, blue-striped-bonus wagers, striped-bonus wagers, aggregate wagers, and the like, as discussed in further detail below.

Figure 3:
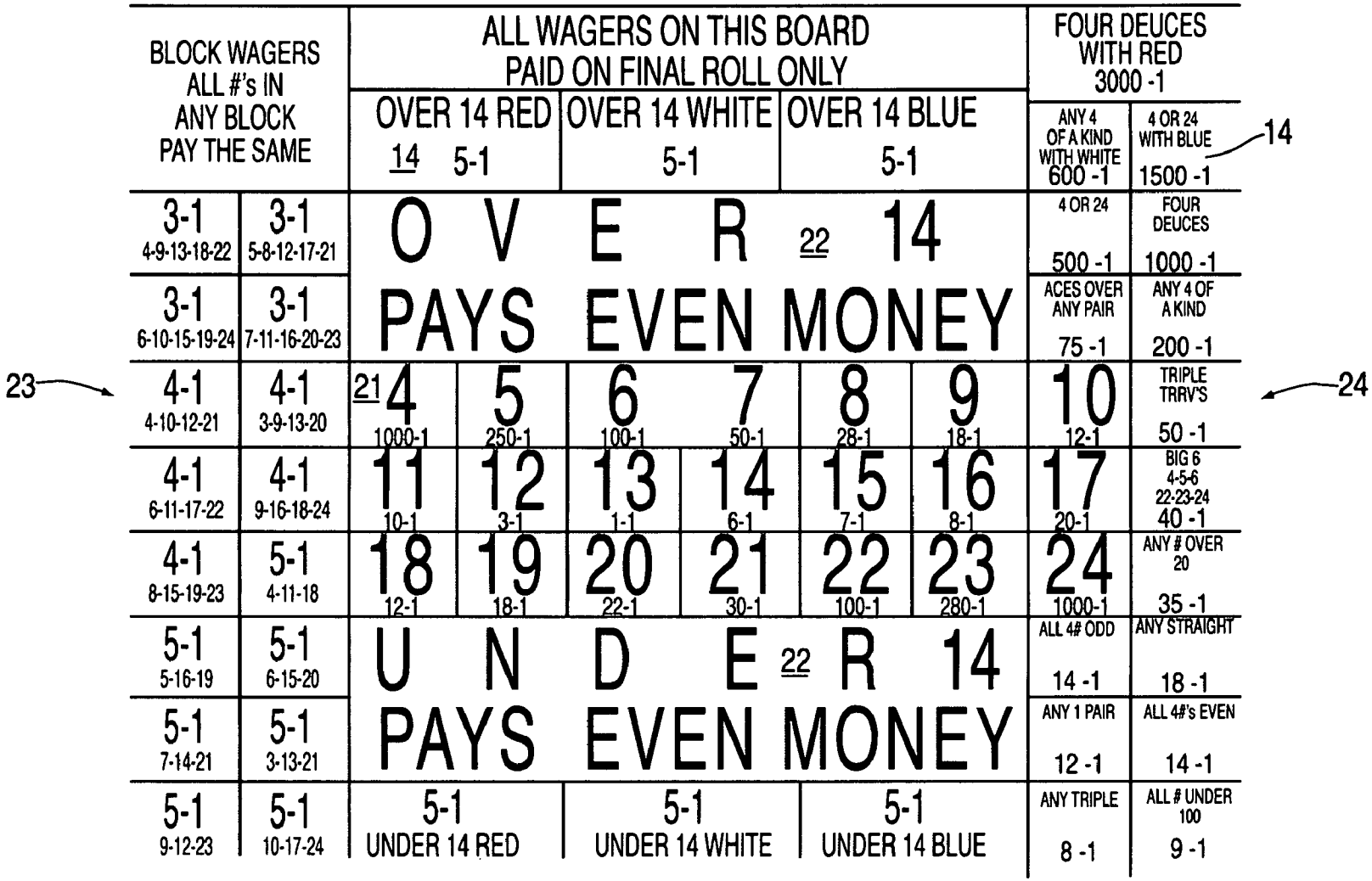
FIG. 3 is a wager group of a preferred embodiment of the present invention.

FIG. 3 illustrates a wager group of a preferred embodiment of the present invention. Wager areas 14 included in this wager group include wagers dependent on the total rolled values of dice 1-4, as well as the value of bonus die 5, and may be called "aggregate wagers", "final roll wagers" or "final roll bets". These final roll wagers are wagers on an aggregate event defined by combining the outcomes of the individual events; that is, the aggregate event may defined by combining the values of the outcome of the rolls of dice 1-4, 1-4 plus bonus die 5, or combinations thereof. Examples of aggregate events may therefore include "total of 17 for dice 1-4" and "total of 17 for dice 1-4 and red for dice 5", among others.

Wager areas in this wager group include wagers on the total of the rolled values of dice 1-4, 21, wagers that the total of the rolled values of dice 1-4 are over or under 14 ("over-under" wagers), 22, and block wagers, that is, wagers that the total of the rolled values of dice 1-4 will be one of a predefined block of several values, 23. For example, block wagers may be on: blocks of two aggregate values (e.g., that the total will be one of 18 or 22), blocks of three aggregate values (e.g., that the total will be one of 7, 14 or 21), blocks of four aggregate values (e.g., that the total will be one of 6, 11, 17 or 22), blocks of five aggregate values (e.g., that the total will be one of 4, 9, 13, 18 or 22), or blocks of six aggregate values (e.g., that the total will be one of 4, 9, 13, 18, 21 or 22).

Also included in this wager group are "specialty wagers", 24, such as "four deuces" (i.e., that each die, excluding the bonus die, will show a two), any two pair (i.e., that the dice, excluding the bonus die, will show two numbers each repeated on two dice), all even (i.e., that the value of each die, excluding the bonus die, will be an even value), three of a kind (i.e., that the dice, excluding the bonus die, will show the same number repeated on three dice), four of a kind (i.e., that the dice, excluding the bonus die, will show the same number repeated on all four dice), and the like.

The over-under wagers just discussed are best implemented in embodiments having an even number of dice or other random event generators such as prize wheels so that the set of all possible outcomes includes a "pivot number"; that is, a single median value within the set of all possible outcomes. Other embodiments may include sets of all possible outcomes which have more than a single pivot number; that is, two or more median values within the set of all possible outcomes. In such embodiments, over or under wagers may be adjusted to be over the highest of pivot numbers and below the lowest of pivot numbers. The pivot number may also be referred to as the "house number".

Tables 1 and 2 provide a complete list of wagers illustrated in FIG. 2, including odds of winning and payout odds of the present preferred embodiment.

TABLE 1

| Single Aggregate Value Wager | Odds | Payout |
|---|---|---|
| 4, 24 | 1296-1 | 1000-1 |
| 5, 23 | 324-1 | 250-1 |
| 6, 22 | 129.6-1 | 100-1 |
| 7, 21 | 64.8-1 | 50-1 |
| 8, 20 | 37-1 | 28-1 |
| 9, 19 | 23.1-1 | 18-1 |
| 10, 18 | 16.2-1 | 12-1 |
| 11, 17 | 12.5-1 | 10-1 |
| 12, 16 | 10.4-1 | 8-1 |
| 13, 15 | 9.3-1 | 7-1 |
| 14 | 8.9-1 | 6-1 |

TABLE 2

| Wager | Odds | Payout |
|---|---|---|
| Any Five-Result Block Wager (e.g., total equaling any of 4, 9, 13, 18 or 22, etc.) | 3.5-1 | 3-1 |
| Four-Result Block Wagers 4-10-12-21, 6-11-17-22 and 7-16-18-24 | 4.7-1 | 4-1 |
| Four-Result Block Wagers 5-9-13-20 and 8-15-19-23 | 4.5-1 | 4-1 |
| Any Three-Result Block Wager (e.g., total equaling any of 4, 11 or 18, etc.) | 6-1 | 5-1 |
| Over/Under (i.e., over 14 or under 14) | 1.3-1 | 1-1 |
| Over/Under plus Bonus Die (e.g., over 14 plus red) | 5.8-1 | 5-1 |
| Any Triple | 10.1-1 | 8-1 |
| Under 10 | 9.3-1 | 9-1 |
| Any Two Pair | 12.5-1 | 12-1 |
| All Even/Odd (i.e., each die even or each die odd) | 15-1 | 14-1 |
| Any Straight (e.g., 2-3-4-5, etc.) | 26-1 | 18-1 |
| Over 20 (i.e., the total of the dice being greater than 20) | 36-1 | 35-1 |
| Big 6 (i.e., total equaling any of 4, 5, 6, 22, 23 or 24) | 42.2-1 | 40-1 |
| Triple 3's (i.e., three dice each showing 3) | 60.7-1 | 50-1 |
| Aces Over Any Pair (i.e., a pair of aces and any other pair) | 80-1 | 75-1 |
| Any Four of a Kind | 215-1 | 200-1 |
| 4 or 24 (i.e., the total equaling 4 or 24) | 647-1 | 500-1 |
| Four Deuces (i.e., each die showing 2) | 1295-1 | 1000-1 |
| Any Four of a Kind Plus White | 647-1 | 600-1 |
| 4 or 24 Plus Blue | 1943-1 | 1500-1 |
| Four Deuces Plus Red | 3887-1 | 3000-1 |

Figure 4:
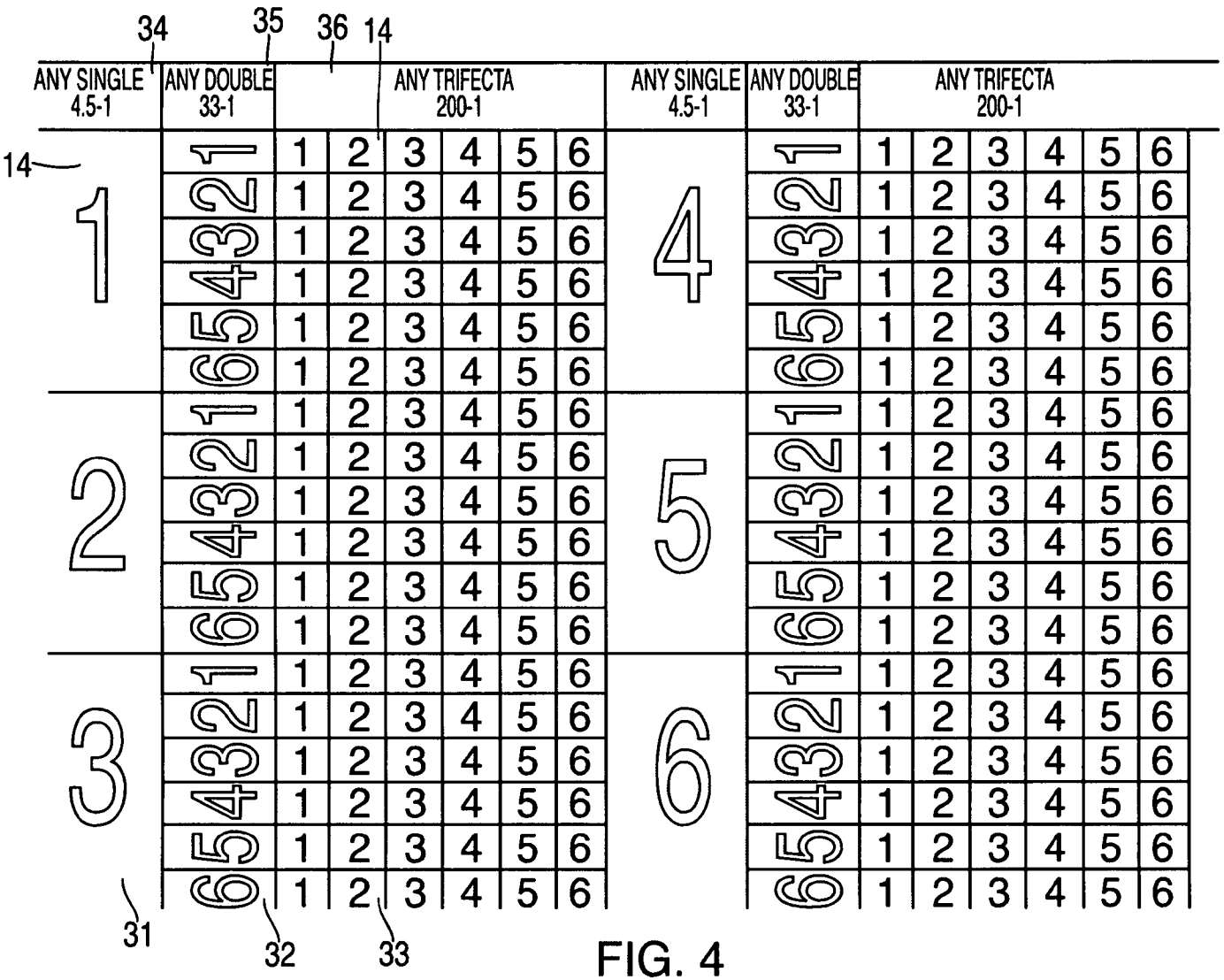
FIG. 4 is another wager group of a preferred embodiment of the present invention.

FIG. 4 illustrates another wager group of a preferred embodiment of the present invention. Wager areas 14 included in this wager group include wagers on the outcome of the roll of the red die ("single" or "single wager"), red and white dice ("double" or "double wager"), or red, white and blue dice ("trifecta" or "trifecta wager"). For example, a single wager made in wager area 31 wins when the number 3 is rolled on the red die. A double wager made in wager area 32 wins when the number 3 is rolled on the red die and the number 6 is rolled on the white die (that is, both conditions must be met for the wager to be successful). In a similar fashion, a trifecta wager made in wager area 33 wins when the number 3 is rolled on the red die and the number 6 is rolled on the white die and the number 2 is rolled on the blue die (that is, all three conditions must be met for the wager to be successful). The payout odds for winning single wagers are shown in box 34, for winning double wagers in box 35, and for winning trifecta wagers in box 36. Table 3 provides a complete list of wagers illustrated in FIG. 4, including odds of winning and payout odds of the present preferred embodiment.

TABLE 3

| Wager | Odds | Payout |
|---|---|---|
| Any Single (e.g., 1, 2, etc.) | 5-1 | 4.5-1 |
| Any Double (e.g., 1-1, 1-2, etc.) | 35-1 | 33-1 |
| Any Trifecta (e.g., 1-1-1, 1-1-2, etc.) | 215-1 | 200-1 |

Figure 5:
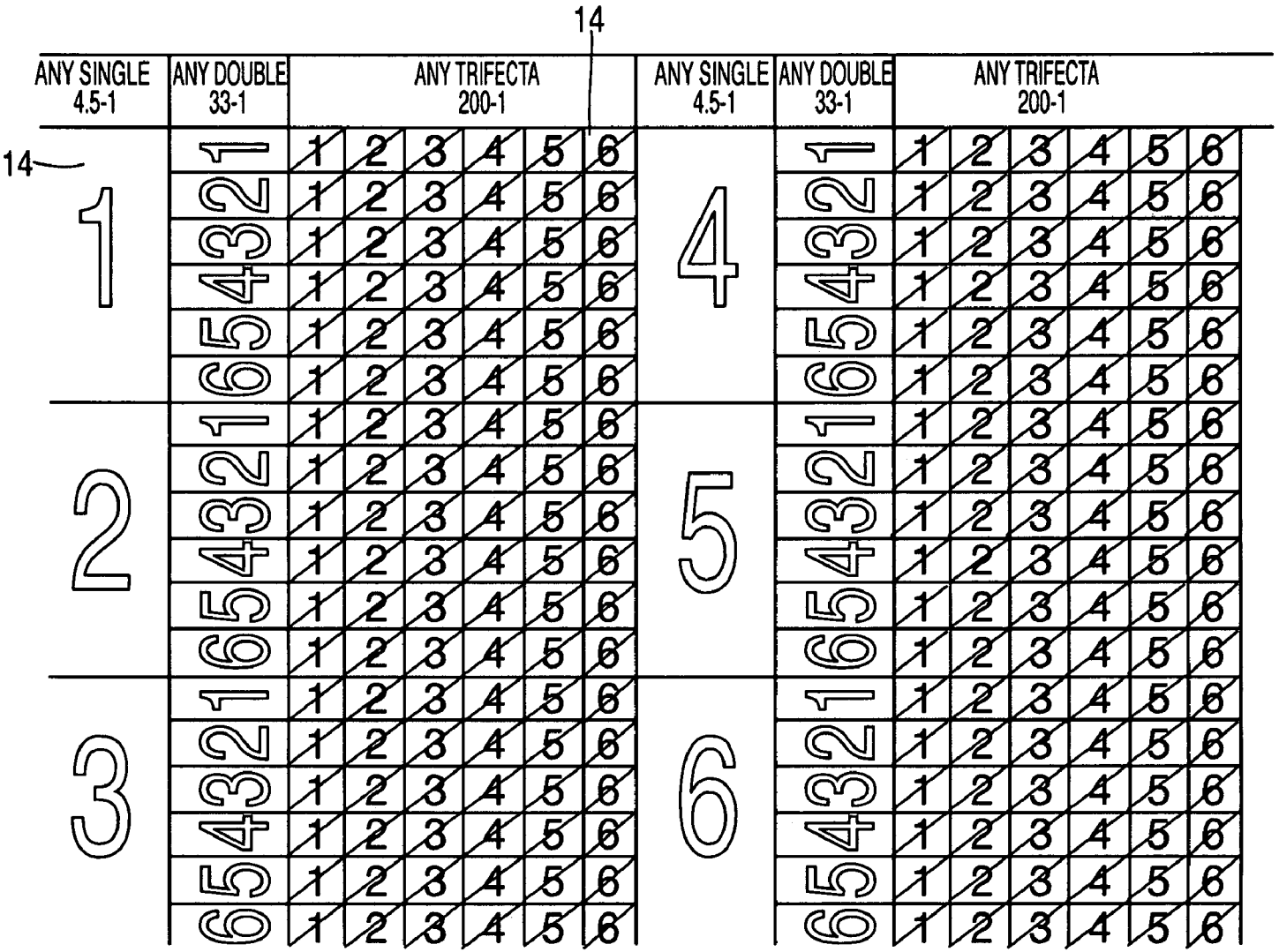
FIG. 5 is another wager group of a preferred embodiment of the present invention.

FIG. 5 illustrates another wager group of a preferred embodiment of the present invention. Wager areas 14 included in this wager group include wagers on the outcome of the roll of the white die (single), white and blue dice (double), or white, blue and striped dice (trifecta). These wagers operate in the same manner as the wagers disclosed in connection with FIG. 4, with the white die substituted for the red die of the previous wager group, the blue die substituted for white die of the previous wager group, and the striped die substituted for the blue die of the previous wager group. The odds of winning and payout odds are the same as those tabulated in Table 3.

Figure 6:
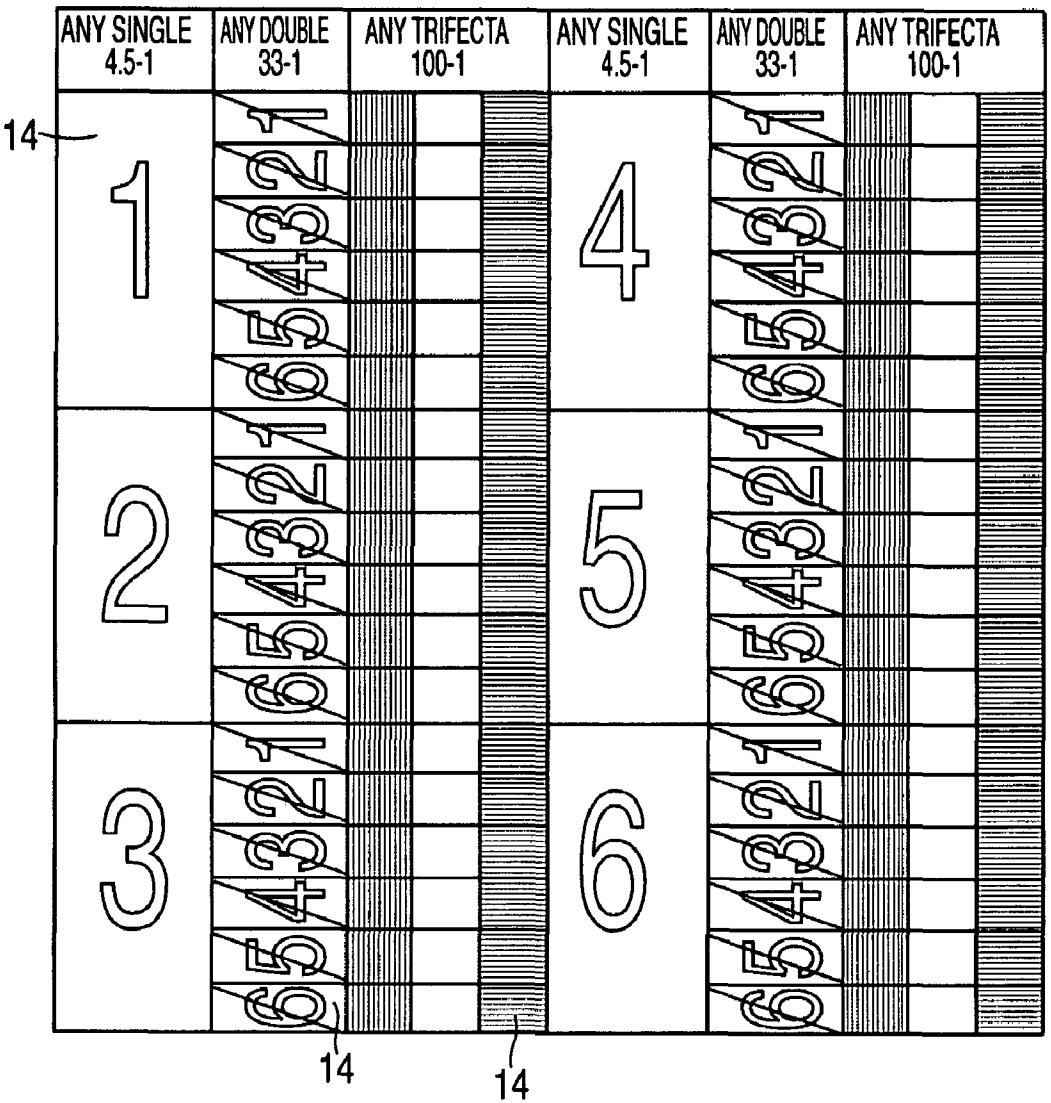
FIG. 6 is another wager group of a preferred embodiment of the present invention.

FIG. 6 illustrates an additional wager group of a preferred embodiment of the present invention. Wager areas 14 included in this wager group include wagers on the outcome of the roll of the blue die (single), blue and striped dice (double), or blue, striped and bonus dice (trifecta). The odds of winning an payout odds for the wagers of this wager group are shown in Table 4.

TABLE 4

| Wager | Odds | Payout |
|---|---|---|
| Any Single (e.g., 1, 2, etc.) | 5-1 | 4.5-1 |
| Any Double (e.g., 1-1, 1-2, etc.) | 35-1 | 33-1 |
| Any Trifecta (e.g., 1-1-red, 1-1-blue, etc.) | 107-1 | 100-1 |

Figure 7:
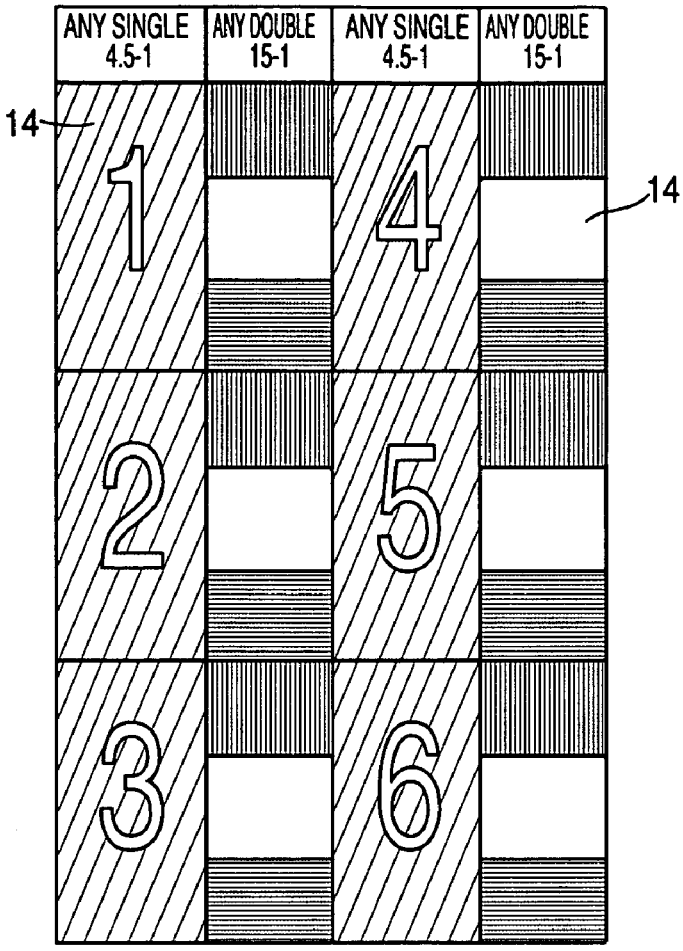
FIG. 7 is another wager group of a preferred embodiment of the present invention.

Finally, FIG. 7 illustrates another wager group of a preferred embodiment of the present invention. Wager areas 14 included in this wager group include wagers on the outcome of the roll of the striped die (single) or striped and bonus dice (double). The odds of winning and payout odds for the wagers of this wager group are shown in Table 5.

TABLE 5

| Wager | Odds | Payout |
|---|---|---|
| Any Single (e.g., 1, 2, etc.) | 5-1 | 4.5-1 |
| Any Double (e.g., 1-red, 1-blue, etc.) | 18-1 | 15-1 |

From the foregoing, it may be seen that wager groups having wagers on the bonus random event may include wagers which are determined in whole or in part by the outcome of the bonus event.

Figure 8:
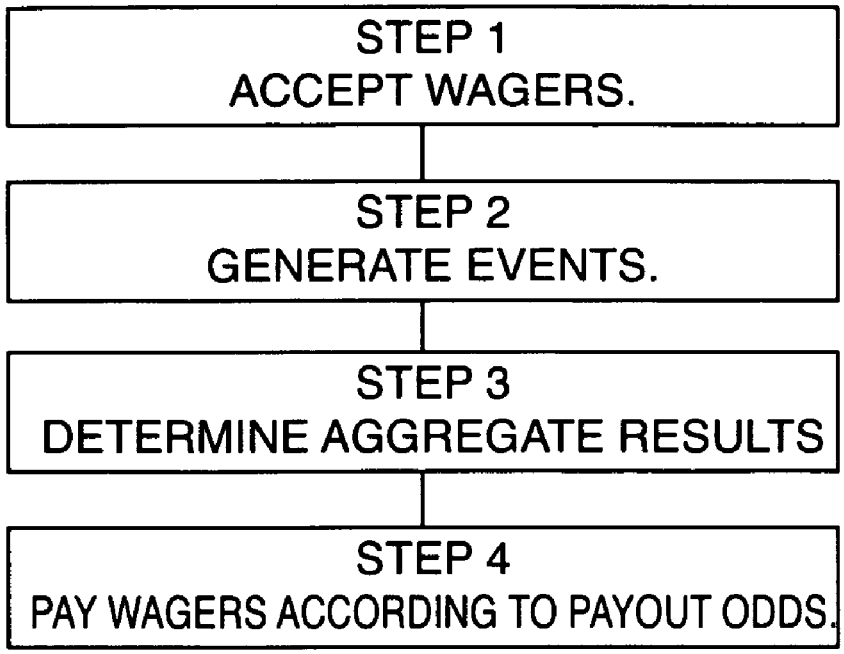
FIG. 8 is a flow chart showing the steps of game play in a preferred embodiment of the present invention.
Figure 10:
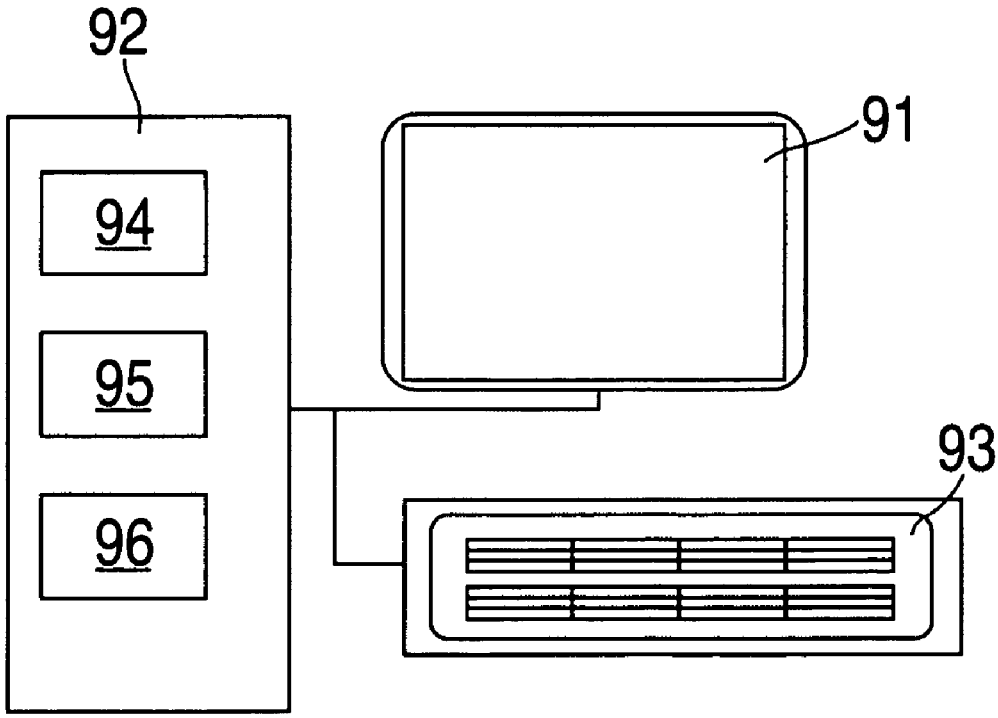
FIG. 10 is a schematic depiction of a computer based machine embodiment of the present invention.

The steps of the present preferred embodiment may be summarized by the flow chart of FIG. 8. The game begins with the one or more wagers being made in step 1. Following step 1, the random events are generated in step 2. Next, in step 3, the aggregate results are determined, for example, by summing the resulting values of dice 1-4. Finally winning wagers are paid in step 4 according the payout odds defined for them. Of course, other sequences may be employed without departing from the present invention. For example, each random event may be generated individually, with all wagers capable of being determined upon the completion of such event being paid at that point (as opposed to being paid only upon the completion of all events).

Figure 9:
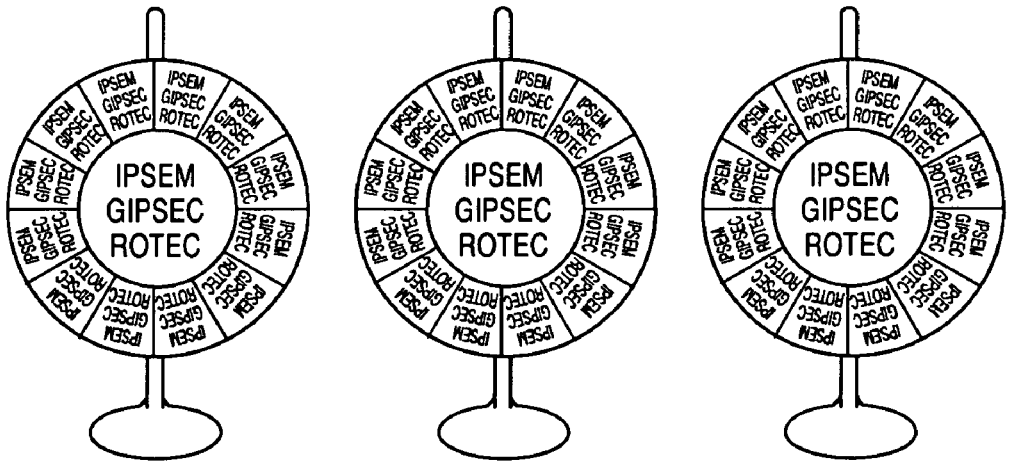
FIG. 9 depicts random event generators in the form of prize wheels.

While the preceding preferred embodiments utilize dice, other random or pseudo-random event generators may be utilized. These include, among others, carnival, "wheel of chance", or prize-wheel type wheels, such as those manufactured by Kardwell International, Inc., P.O. Box 33, Mattituck, N.Y. 11952 and as illustrated in FIG. 9, multiple roulette type wheels, air mix type random number generators such as is disclosed in U.S. Pat. No. 5,121,920 and those manufactured by Smartplay International Inc., One Linda Lane, Suite B, Southampton, N.J. 08088, gravity fed random number generators such as those manufactured by Smartplay International Inc., bingo cages, such as those manufactured by Kardwell International, Inc., and the like.

Similarly, the entirety of the present invention may be implemented as an electronic or computer based game. In such embodiments, a computer consisting of a display device, 91, central processing unit, 92, input device such as a keyboard, touchscreen or dedicated mechanical buttons, 93, volatile and non-volatile memory, 94, central processing unit, 95, pseudo-random number generator, 96 (which may be in the form of a computer routine executed by central processing unit 95), may be utilized to implement the game of chance of the present invention. Alternatively, dedicated logic may be utilized in place of a programmed computer. Such devices, which may be in a form similar to video poker type machines currently well known to those of skill in the art, may be programmed to present applicable wagers to players, accept wagers from players, generate the necessary random or pseudo-random events, and pay winning wagers in accordance with payout odds associated with the winning wagers.

While particular embodiments of the present invention have been shown and described, it will be apparent to those skilled in the pertinent art that changes and modifications may be made without departing from the invention in its broader aspects.

What is claimed is:

1. A method of playing a game of chance comprising the steps of:

a. defining a set of wagers on the outcome of a plurality of differentiable random events, said random events defining an aggregate event having a value;

b. defining a set of payout odds associated with said wagers;

c. accepting at least one player wager for at least one wager in said set of wagers;

d. generating said plurality of differentiable random events;

e. paying winning wagers according to said payout odds; wherein said set of wagers includes a plurality of wager groups, said wager groups including a first wager group comprising at least one of double and trifecta wagers and a second wager group comprising wagers on said aggregate event, said double wagers including at least one wager on a non-equal, non-consecutive non-sum total combination of two outcomes from only two random events selected from said set of wagers on the outcome of the plurality of said differentiable random events and said trifecta wagers including at least one wager on a non-equal, non-consecutive non-sum total combination of three outcomes from only three random events selected from said set of wagers on the outcome of the plurality of said differentiable random events said second wager group including at least one wager selected from the group comprising equal, consecutive and sum total combinations of at least two outcomes from said set of differentiable events.

2. The method of claim 1, wherein said second wager group comprises an under wager and an over wager, said under wager and said over wager being separated by a pivot value.

3. The method of claim 2, wherein said plurality of differentiable random events includes a first, second, third and fourth random event; and said first wager group includes at least one of a single wager on said first random event, a double wager on said first and second random events, and a trifecta wager on said first, second and third random events.

4. The method of claim 3, wherein said plurality of differentiable random events are generated by at least one of the group of: (a) one or more dice; (b) one or more prize wheels; (c) one or more roulette type wheels; (d) one or more air mix type random number generators; (e) one or more gravity fed random number generators; and (f) one or more pseudo random number generators.

5. The method of claim 2, wherein said plurality of differentiable random events includes a first, second, third and fourth random event and said second wager group includes a plurality of wagers on aggregate values of said first, second, third and fourth random events.

6. A method of playing a game of chance comprising the steps of:

a. selecting a wager from a pre-defined set of wagers on the outcome of a plurality of differentiable random events, said random events defining an aggregate event having a value and said pre-defined set of wagers having a pre-defined set of payout odds associated therewith;

b. awaiting the outcome of said plurality of differentiable random events; and c. collecting payment for winning wagers according to said payout odds wherein said set of wagers includes a plurality of wager groups, said wager groups including a first wager group comprising at least one of double and trifecta wagers and a second wager group comprising wagers on said aggregate event, said double wagers including at least one wager on a non-equal, non-consecutive non-sum total combination of two outcomes from only two random events selected from said set of wagers on the outcome of the plurality of said differentiable random events and said trifecta wagers including at least one wager on a non-equal, non-consecutive non-sum total combination of three outcomes from only three random events selected from said set of wagers on the outcome of the plurality of said differentiable random events, said second wager group including at least one wager selected from the group comprising equal, consecutive and sum total combinations of at least two outcomes from said set of differentiable event.

7. The method of claim 6, wherein said second wager group comprises an under wager and an over wager, said under wager and said over wager being separated by a pivot value.

8. The method of claim 7, wherein said plurality of differentiable random events includes a first, second, third and fourth random event; and said first wager group includes at least one of, a double wager on said first and second random events, and a trifecta wager on said first, second and third random events.

9. The method of claim 8, wherein said plurality of differentiable random events are generated by at least one of the group of: (a) one or more dice; (b) one or more prize wheels; (c) one or more roulette type wheels; (d) one or more air mix type random number generators; (e) one or more gravity fed random number generators; and (f) one or more pseudo random number generators.

10. The method of claim 7, wherein said plurality of differentiable random events includes a first, second, third and fourth random event and said second wager group includes a plurality of wagers on aggregate values of said first, second, third and fourth random events.

11. A game of chance comprising:

a wager area for accepting wagers, said wager area having a set of wagers on the outcome of a plurality of differentiable random events, said random events defining an aggregate event having a value;

a set of payout odds associated with said wagers; and a random event generator for generating said plurality of differentiable random events wherein winning wagers accepted in said wager area are paid in accordance with said payout odds;

wherein said set of wagers includes a plurality of wager groups, said wager groups including a first wager group comprising at least one of double and trifecta wagers and a second wager group comprising wagers on said aggregate event, said double wagers including at least one wager on a non-equal, non-consecutive non-sum total combination of two outcomes from only two random events selected from said set of wagers on the outcome of the plurality of said differentiable random events and said trifecta wagers including at least one wager on a non-equal, non-consecutive non-sum total combination of three outcomes from only three random events selected from said set of wagers on the outcome of the plurality of said differentiable random events said second wager group including at least one wager selected from the group comprising equal, consecutive and sum total combinations of at least two outcomes from said set of differentiable event.

12. The method of claim 11, wherein said second wager group comprises an under wager and an over wager, said under wager and said over wager being separated by a pivot value.

13. The method of claim 12, wherein said plurality of differentiable random events includes a first, second, third and fourth random event; and said first wager group includes at least one of a single wager on said first random event, a double wager on said first and second random events, and a trifecta wager on said first, second and third random events.

14. The method of claim 13, wherein said plurality of differentiable random events are generated by at least one of the group of: (a) one or more dice; (b) one or more prize wheels; (c) one or more roulette type wheels; (d) one or more air mix type random number generators; (e) one or more gravity fed random number generators; and (f) one or more pseudo random number generators.

15. The method of claim 12, wherein said plurality of differentiable random events includes a first, second, third and fourth random event and said second wager group includes a plurality of wagers on aggregate values of said first, second, third and fourth random events.

* * * * *